United States Patent [19]

Okada

[11] Patent Number: 4,753,625

[45] Date of Patent: Jun. 28, 1988

[54] COIN PAY-OUT APPARATUS

[75] Inventor: Kazuo Okada, Tokyo, Japan

[73] Assignee: Kabushiki Kaisha Universal, Oyama, Japan

[21] Appl. No.: 886,368

[22] Filed: Jul. 17, 1986

[30] Foreign Application Priority Data

Jul. 17, 1985 [JP] Japan ..... 60-156086
Aug. 26, 1985 [JP] Japan ..... 60-185794

[51] Int. Cl.[4] ..... G07D 9/04
[52] U.S. Cl. ..... 453/32; 377/7
[58] Field of Search ..... 133/4 R, 4 A, 8 R, 8 A, 133/8 B, 8 C, 8 D; 194/200; 377/7; 453/30, 32

[56] References Cited

U.S. PATENT DOCUMENTS 3,948,279 4/1976 Gupta ..... 133/4 R X
4,041,280 8/1977 Ohsako et al. ..... 133/8 R X
4,356,829 11/1982 Furuya ..... 133/8 R
4,398,550 8/1983 Shireman ..... 133/8 R X
4,441,515 4/1984 Goepner ..... 133/8 R X

FOREIGN PATENT DOCUMENTS 0064822 11/1982 European Pat. Off. .
2758409 7/1978 Fed. Rep. of Germany .
3101480 1/1982 Fed. Rep. of Germany .
2105508 3/1983 United Kingdom .

*Primary Examiner*—F. J. Bartuska
*Attorney, Agent, or Firm*—Young & Thompson

[57] ABSTRACT

A coin pay-out apparatus in which a rotary disc is rotated by a motor to effect a coin pay-out. The motor is controlled by a plurality of binary input signals. Only when a combination of the plurality of input signals is found to be a predetermined combination including the binary input signals, is the motor driven to rotate the rotary disc in the normal direction so that coins are paid out. In this way, erroneous payment of coins can be prevented. In the event of a coin jam, the motor is driven in the reverse direction to clear the jam. The number of times the motor is thus reversely driven is counted, and when the count reaches a predetermined number, a warning of malfunction is given.

3 Claims, 5 Drawing Sheets

COIN PAY-OUT APPARATUS

BACKGROUND OF THE INVENTION

This invention relates, in general, to a coin pay-out apparatus. In one aspect, it relates to a control apparatus of a coin pay-out apparatus in which the coin pay-out apparatus is prevented from erroneously paying out coins. In another aspect, it relates to a coin pay-out apparatus having such a function as to automatically remove coin jamming.

An automatic vending machine, a money exchanger, or a game machine such as a slot machine, in which a coin or token is used, includes a coin or token pay-out apparatus for paying out coins or tokens (hereinafter referred to generically as "coins") into a discharge port. Such a coin pay-out apparatus is connected to a bucket containing a number of coins. A bottom portion of the bucket is formed with an opening through which the coins to be paid out are fed into the coin pay-out apparatus.

The coin pay-out apparatus includes a rotary disc driven by a motor. The rotary disc is actuated in response to a coin pay-out signal. When the rotary disc plate is actuated, coins are discharged one by one through the discharge port provided adjacent to the circumference of the rotary disc. Disposed in the vicinity of the discharge port is a coin sensor for detecting the discharged coins one by one. A detection signal emitted from the coin sensor is counted by a counter. At the time the counted figure reaches a predetermined number of coins paid out, a pay-out end signal is issued. As a result, the rotary disc is stopped.

As the bucket contains a large number of coins to be paid out, the coins are sometimes overlapped with respect to one another to form a so-called bridge at an upper portion of the opening of the bucket, which invites a coin jam. If such a coin jam takes place, no coins reach the rotary disc from the opening of the bucket. In this case, even if the rotary disc is rotated, no coins are paid out.

Operation of the coin pay-out apparatus is effected by controlling with an electric signal the motor for rotating the rotary disc. However, if the motor is actuated by only the coin pay-out signal, it can happen that coins are suddenly paid out when a false coin pay-out signal is generated due to, for example, noise caused by static electricity and/or noise produced by the environment. Furthermore, in the case that such coin pay-out apparatus is built into a game machine, it can happen that the coin pay-out apparatus may be actuated by a misfunction of the program for running the game.

Furthermore, in conventional coin pay-out apparatus, when the aforementioned coin jam occurs, the jam must be cleared manually. Accordingly, when a coin jam occurs in a coin pay-out apparatus employed in a game machine such as, for example, a slot machine, the game must be interrupted to clear the coin jam. This is annoying both to the proprietor and to the customer.

The present invention overcomes these problems of the prior art.

OBJECTS OF THE INVENTION

It is therefore a first object of the present invention to provide a coin pay-out apparatus, wherein a motor for actuating the coin pay-out apparatus will not be driven by a false coin pay-out signal generated due to noise or the like.

A second object of the present invention is to provide a coin pay-out apparatus, wherein coin jams, when they occur, can be automatically cleared.

SUMMARY OF THE INVENTION

In order to achieve the first object, there is provided a coin pay-out apparatus, wherein a motor for rotating a rotary disc of the coin pay-out apparatus is actuated by a plurality of input signals. The input signals may be a binary signal formed of a high level signal (hereinafter referred to simply as "H signal") and a low level signal (hereinafter referred to simply as "L signal"), the arrangement being such that only when a combination of the plurality of input signals is found to be a predetermined combination including the respective H and L signals, is the motor driven in the normal direction.

According to a preferred embodiment of the present invention, the plurality of input signals include a normal rotation signal for actuating a motor in such a manner as to rotate a rotary disc in the direction for paying out a coin (i.e., in the normal direction), a reverse rotation signal for rotating the rotary disc plate in the reverse direction in order automatically to clear a coin jam, and a drive signal which is emitted until the number of paid-out coins reaches a predetermined number. Only when the combination of the respective normal, reverse and drive signals is found to be H, L and H, is the rotary disc rotated in the direction for paying out a coin.

In order to achieve the second object, there is also provided a coin pay-out apparatus in which a rotary disc is rotated by a motor to effect a coin pay-out. It comprises means for generating a normal rotation signal to rotate the rotary disc in the normal direction in order to discharge coins one by one from a discharge port, means for detecting the coins discharged from the discharge port and outputting a detection signal, means for generating a reverse rotation signal temporarily, and means for rotating the rotary disc in the normal direction again after the rotary disc was rotated in the reverse direction by the reverse rotation signal generating means.

According to another preferred embodiment of the present invention, means for detecting non-payment of coins within a predetermined time after a coin pay-out signal is emitted includes the same coin sensor which was originally employed for counting the number of paid out coins. In this way, complicated coin pay-out apparatus is avoided. Generally, a shot sensor and a micro switch are used as this coin sensor. When a coin counting signal is not obtained successively from this coin sensor within a predetermined time, a motor for actuating the rotary disc plate is reversely rotated.

BRIEF DESCRIPTION OF THE DRAWINGS

The drawings furnished herewith illustrate the best mode presently contemplated by me for carrying out the present invention and described hereinafter.

In the drawings.

DETAILED DESCRIPTION OF THE INVENTION

A preferred embodiment of the present invention will be described hereunder with reference to the accompanying drawings.

Figure 3:
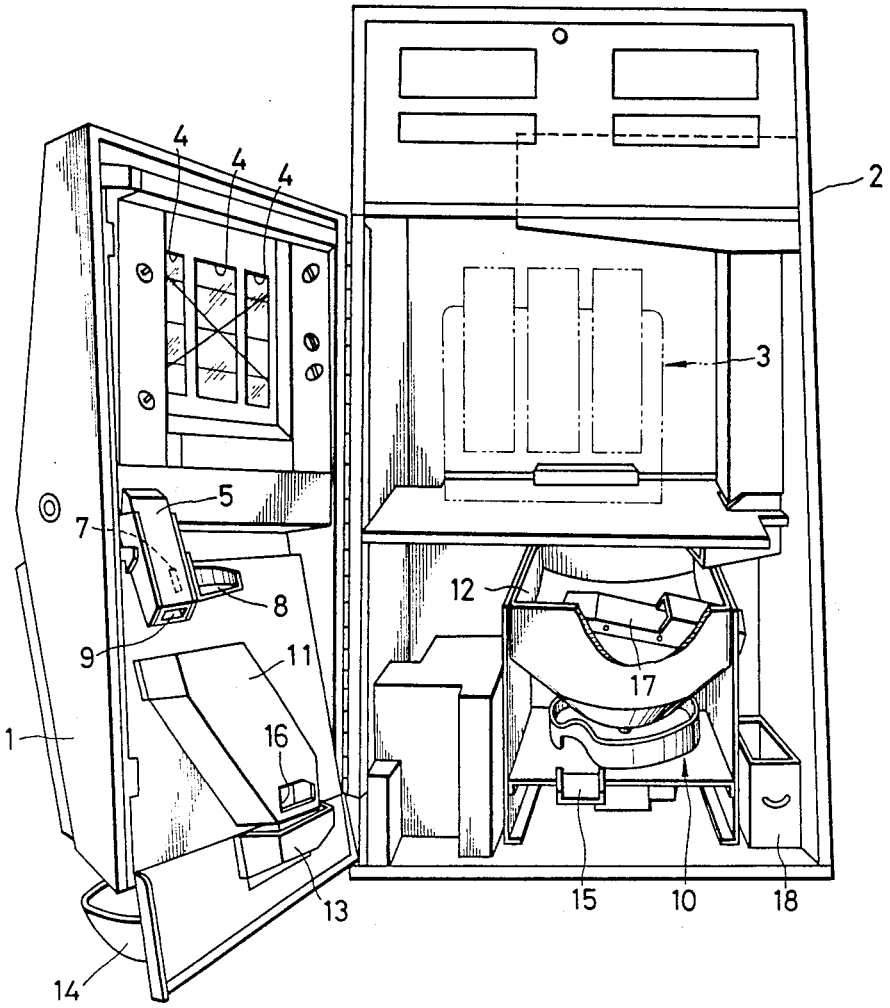
FIG. 3 is a perspective view of a slot machine with its door open, incorporating a coin pay-out apparatus of the present invention.

In FIG. 3 showing a slot machine with its front door 1 open, a main body 2 on which is swingably mounted the front door 1 is provided with a known reel apparatus 3 including three reel members provided on their outer peripheries with symbols. Although the front door 1 is shut when a game is played, a part of the symbol arrangement of the respective reel members is visible through an observation window 4 formed on the front door 1. A coin inserted into the machine prior to the start of a game is fed to a coin selector 5 that communicates with a coin inlet port (not shown). The coin selector 5 judges whether the coin inserted into the machine is genuine or not and a coin judged as genuine by the coin selector 5 is fed into a bucket 12 of a coin pay-out apparatus 10 through an outlet port 7 and a trough 8. On the other hand, a coin judged as false by the coin selector 5 is sent back to a coin receiving tray 14 through an outlet port 9, a trough 11 and a chute 13.

When a player wins a prize during play, the coin pay-out apparatus 10 is actuated and the number of coins corresponding to the prize are dispensed from a chute 15. Such dispensed coins are paid out into the coin receiving tray 14 through an opening 16 formed in the trough 11. The bucket 12 is provided at its inside with an overflow chute 17 adapted to guide coins inserted into the machine when the bucket 12 is already full of coins into an overflow bucket 18.

Figure 4:
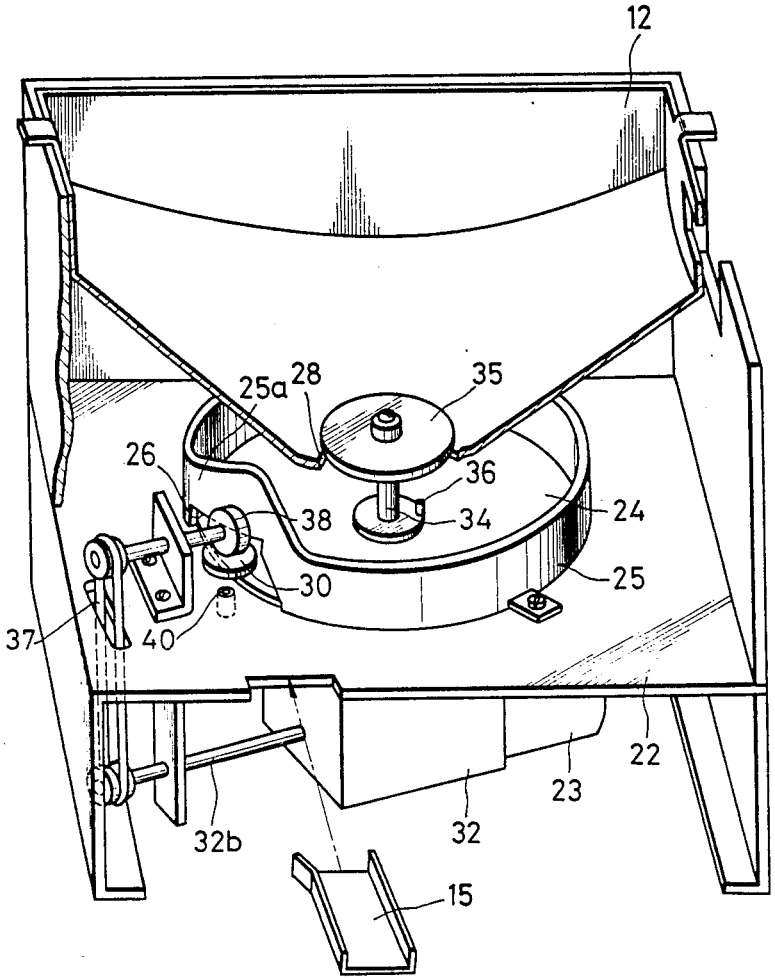
FIG. 4 is a perspective view of a coin pay-out apparatus embodying the present invention.
Figure 5:
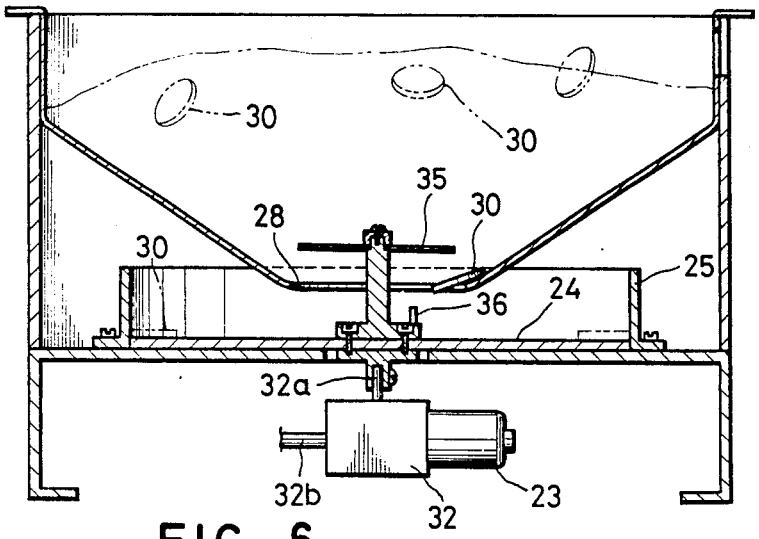
FIG. 5 is a sectional view of an important portion of the coin pay-out apparatus of FIG. 4.
Figure 6:
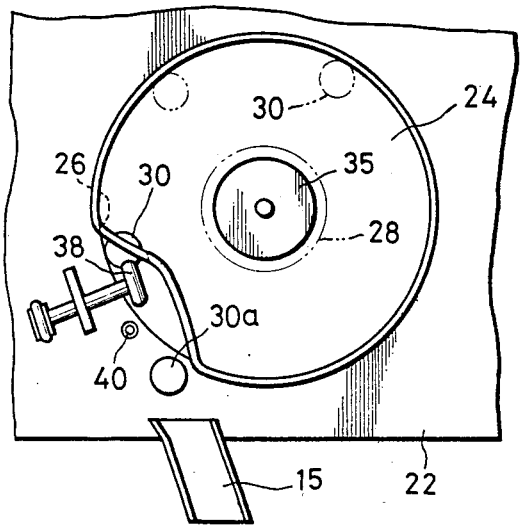
FIG. 6 is a plan view of an important portion of the coin pay-out apparatus of FIG. 3.

In FIGS. 4, 5 and 6 showing one example of the coin pay-out apparatus 10, a base plate 22 generally horizontally mounted on the main body 2 of the slot machine is provided with a rotary disc 24 rotated by a motor 23 and an output shaft 32*a* of a gear box 32. A guide plate 25 is firmly attached to base plate 22 and is formed in a generally cylindrical shape in such a manner as to enclose the outer periphery of the rotary disc 24. A part of the guide plate 25 is formed with a bent portion 25*a* bending inwardly of the rotary disc 24.

A lower edge of the bent portion 25*a* is formed with a laterally elongated slit 26. The height and width of the slit 26 is large enough to permit only one coin 30 to pass therethrough on its side. Between the outer periphery of the rotary disc 24 and the inner wall of the guide plate 25, there can be a space, so long as the size thereof is less than a radius of the coin 30.

Spaced above the base plate 22, a funnel-shaped bucket 12 with an opening 28 formed at its bottom is disposed. A number of coins to be used for pay-out are contained in the bucket 12, and coins inserted into the machine prior to start of a game also fall into the bucket 12 as such coins are inserted into the machine. The coins contained in the bucket 12 are fed onto the rotary disc 24 through the opening 28. To facilitate this feed, the rotary disc 24 is provided with a supporting post 34 extending upwardly therefrom and extending into the bucket 12 through the opening 28 of the bucket 12. The upper end of the supporting post 34 carries an annular regulating plate 35 that is rotatable on and relative to the post 34. A lower flange of the support post 34 carries an upstanding pin 36.

Disposed in the vicinity of the slit 26 formed on the guide plat 25 is an elastic roller 38 made of, for example, a rubber material. This roller 38 is adapted to feed a coin 30 that has passed through the slit 26 into the chute 15. The roller 38 is rotated by an output shaft 32*b* generally horizontally projecting from the gear box 32. In the case that the roller 38 is disposed directly above the rotary disc 24 as shown in FIG. 4, it is preferable that the roller 38 is not in contact with the rotary disc 24. However, if the rotary disc 24 and the roller 38 are relatively adjustable as to the speed of rotation and they rotate at the same peripheral speed, they may be in contact with each other. Otherwise, the roller 38 may be spaced from the rotary disc plate 24. Along the path of a coin 30*a* fed by the roller 38, a coin sensor 40 is provided. The coin sensor 40 is adapted to photo-electrically detect the coins 30*a* fed by the roller 38 every time they pass and output a detection signal. By inputting this detection signal into a counter, the number of coins 30*a* fed by the roller 38 can be counted.

Figure 1:
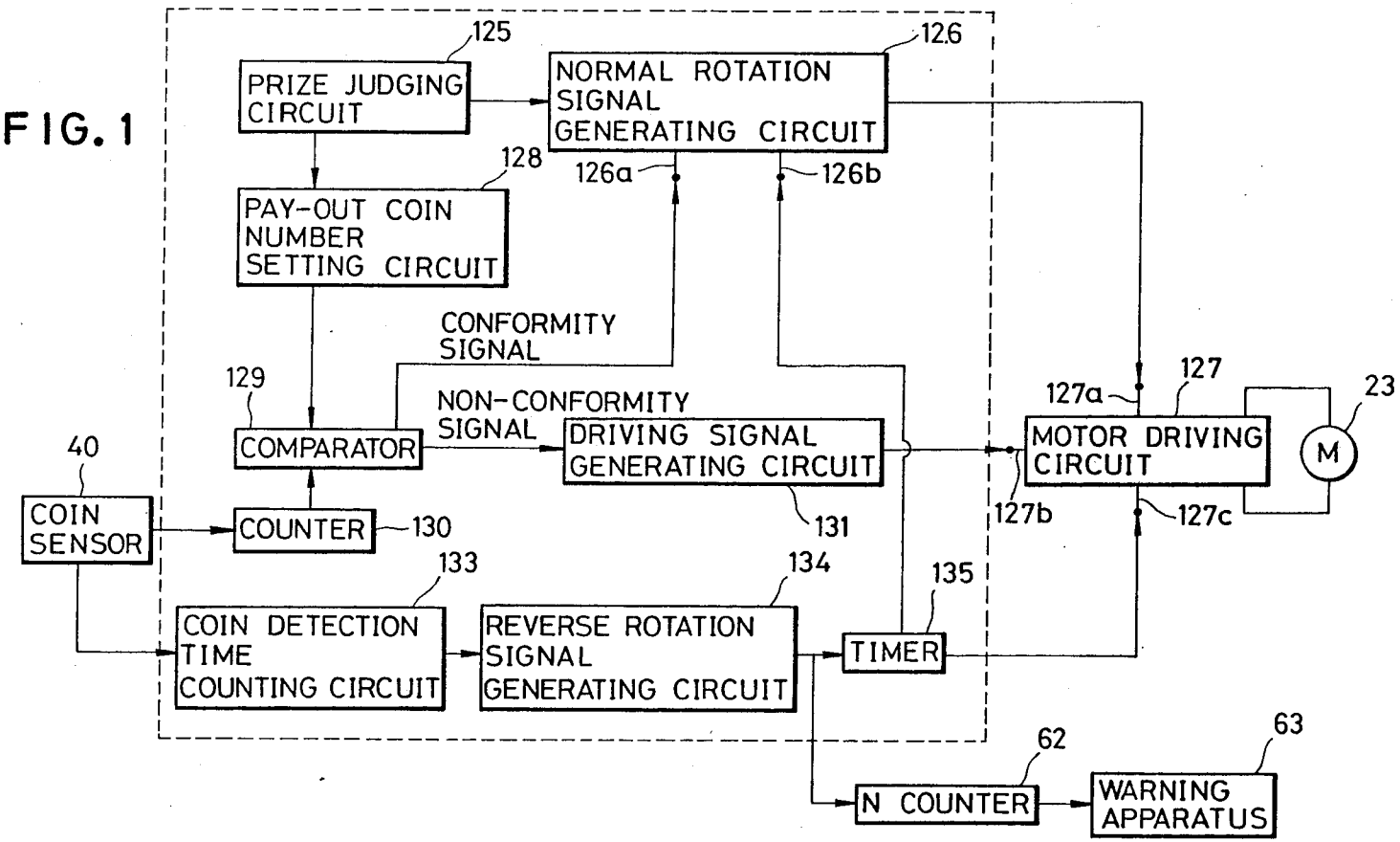
FIG. 1 is a schematic diagram of a circuit showing one example of a coin pay-out apparatus according to the present invention.

In FIG. 1 showing a circuit diagram for controlling the actuation of the rotary disc 24, when a player wins a prize as a result of playing a slot machine game, a coin pay-out signal is outputted to a normal rotation signal generating circuit 126 from a prize judging circuit 125. As a result, the normal rotation signal generating circuit 126 outputs an "H" signal to an input terminal 127*a* of the motor drive circuit 127. At the same time, the prize judging circuit 125 outputs a signal corresponding to the value of the prize of a pay-out coin number setting circuit 128. As a result, the pay-out coin number setting circuit 128 is set with the number of coins corresponding to the value of the prize.

The number of coins set in the pay-out coin setting circuit 128 is compared with the count of the counter 130 by a comparator 129. Since the counter 130 counts the number of coins by adding detection signals emitted from the coin sensor 40 adapted to detect coins 30 paid out from the coin pay-out apparatus, it is held at zero in its initial state. At the time the comparator 129 is actuated in the manner as mentioned before, the comparator 129 outputs a non-conformity signa. When this non-conformity signal is emitted to the drive signal generating circuit 131, the drive signal generating circuit 131 emits an "H" signal to the input terminal 127*b* of the motor driving circuit 127. As will be described later, the input terminal 127*c* of the motor driving circuit 127 is usually fed with an "L" signal.

In this way, when signals fed to the input terminals 127*a*, 127*b* and 127*c* of the motor driving circuit 127 are a combination of "H", "H" and "L", the motor 23 is rotated normally to rotate the rotary disc 24 in the direction to pay out coins. In this way, when the rotary disc 24 is rotated, a coin fed onto the upper surface of the rotary disc 24 is moved together with the rotary disc 24 while moving toward the inner wall of the guide plate 25 due to the centrifugal force received from the rotary disc 24. After the outer periphery of the coin is contacted by the inner wall of the guide plate 25, the coin is rotated together with the rotary disc 24 along the inner wall of the guide plate 25.

When the coin moving along the inner wall of the guide plate 25 arrives at the bent portion 25*a* of the guide plate 25, it is discharged through the slit 26. The discharged coin 30 is impelled by the roller 38 and paid out through the chute 15. The length and width of the slit 26 are only slightly larger than the outer diameters and thickenesses of various coins. Accordingly, coins are reliably discharged one by one through the slit 26. On the way to the chute 15 from the roller 38, the coin 30 passes over the coin sensor 40. As a result, the coin sensor 40 outputs a pulse-like detection signal. Since this detection signal is inputted into the counter 130, the counter 130 adds up the number of paid out coins.

When the counted figure in the counter 130 and the number of coins set up in the pay-out coin number setting circuit 128 are found to be in conformity with each other, the comparator 129 stops outputting a non-conformity signal. At the same time, the comparator 129 emits a conformity signal to the input terminal 126*a* of the normal rotation signal generating circuit 126. As a result, the output terminals of the normal rotation signal generating circuit 126 and the driving signal generating circuit 131 emit "L" signals. In this way, when a combination of signals fed to the input terminals 127*a*, 127*b* and 127*c* of the motor driving circuit 127 is changed to the other state from the previous state of "H", "H", "L", the motor 23 is temporarily stopped to end the coin pay-out action.

In the aforementioned coin pay-out apparatus, even if a large number of coins are contained in the bucket 12, the weight of the coins is largely borne by the regulating plate 35 and a large load is not imposed on the rotary disc 24. Moreover, since the regulating plate 35 is rotatable relative to the supporting post 34, even if the regulating plate 35 is submerged in a large number of coins, the rotary disc 24 is nevertheless rotatable. Thus, the rotary speed of the rotary disc 24 is not reduced. Due to the foregoing, the rotary speed, i.e, the coin pay-out speed can be increased substantially. The pin 36 carried eccentrically by the rotary disc 24 agitates coins fed through the opening 28 of the bucket 12 to prevent a coin jam. But if a coin jam takes place in the vicinity of the opening 28 or the regulating plate 35, no coins will be paid out irrespective of the coin pay-out signal outputted from the prize judging circuit 125 and no detection signals will be outputted from the coin sensor 40.

When the above happens, a reverse rotation signal is outputted from the coin detection time counting circuit 133 actuated by the coin pay-out signal. The coin detection time counting circuit 133 is actuated, when no detection signal is inputted from the coin sensor 40 in a certain time from the time the coin pay-out signal is outputted or in the middle of the coin pay-out action to actuate the reverse rotation signal generating circuit 134. As a result, the reverse rotation signal generating circuit 134 outputs an "H" signal. This "H" signal is held for a predetermined time by a timer 135.

The "H" signal held by the timer 135 is fed to the input terminal 126*b* of the normal rotation signal generating circuit 126 and the input terminals 127*c* of the motor driving circuit 127. Then, the output signal from the normal rotation signal generating circuit 126 becomes "L" and the motor 23 stops revolving. However, when the combination of signals at the input terminals 127*a*, 127*b* and 127*c* of the motor driving circuit 127 becomes "L", "H", "H", the motor driving circuit 127 causes the motor 23 to rotate reversely. That is, the motor 23 so far rotated normally for paying coins is caused to rotate reversely while the "H" signal from the reverse rotation signal generating circuit 134 is held by the timer 135. As a result, the rotary disc 24 is rotated reversely for a predetermined time. Since the reverse rotary force also affects the coin jam, it works extremely effectively when used to remove the coin jam. Of course, since the pin 36 is also rotated reversely together with the reverse rotation of the rotary disc 24, there can be obtained the function of removing the coin jam at the lower part of the opening 28.

When the predetermined time set in the timer 135 has passed, the output signal of the timer 135 returns to the "L" level. Due to this, the normal rotation signal generating circuit 126 outputs the "H" signal again. Since a combination of signals at the input terminals 127*a*, 127*b* and 127*c* of the motor driving circuit 127 becomes "H", "H", "L", the motor 23 is caused to rotate normally again and the coin pay-out operation is resumed. When the storage of the "H" signal in the timer 135 is cancelled, the coin detection time counting circuit 133 is reset. As this coin detection time counting circuit 133, there may be used a known timer circuit for counting the predetermined time by using, for example, the detection signal from the coin sensor 40 as a resetting signal.

While one generation of a coin pay-out signal is being effected, the number of generations of the reverse signal is counted by an N counter 62. When the figure counted by the N counter 62 reaches, for example, three, a warning apparatus 63 is actuated to warn that something abnormal has happened. Thanks to the warning, it is known that there has occurred a coin jam which cannot be relieved by reverse rotation of the rotary disc 24. The count of the N counter 62 is reset to zero at the time a conformity signal is emitted or when no coin pay-out signal is emitted from the prize judging circuit 125.

Figure 2:
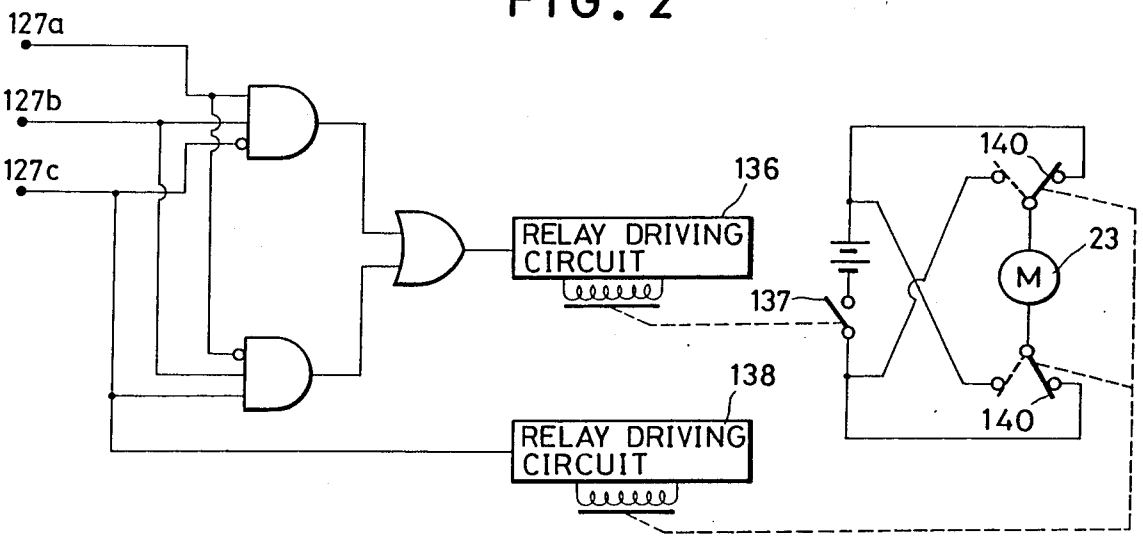
FIG. 2 is a schematic diagram of a circuit showing one example of a motor driving circuit which may be employed in the present invention.

FIG. 2 illustrates one example of the motor driving circuit 127. When a relay driving circuit 136 receives an "H" signal, a power switch 137 is turned on to supply driving current to the motor 23. On the other hand, when a relay driving circuit 138 receives an "L" signal, changeover 140, 140 are positioned as shown by the solid lines to form a normal rotation circuit. Similarly, when this relay driving circuit 138 receives an "H" signal, a reverse rotation circuit is formed as shown by the broken lines in the figure. In this way, if a logical circuit such as an AND circuit, an OR circuit or the like is connected to an after part of the input terminals 127*a*, 127*b* and 127*c* of the motor driving circuit 127 to control the driving of the motor 23 by means of a combination of binary signals and at the same time, to actuate the motor 23 by a combination of signals including the respective binary signals, i.e., both the "H" and "L" signals, the possibility will be almost completely eliminated that the motor 23 may be suddenly driven due to noise or the like. When the present invention is actually used, the number of input signals for driving the motor 23 may be increased in order to further reduce the possibility of an erroneous operation of the coin pay-out apparatus.

The present invention has been described with reference to the illustrated embodiments. The present invention is also applicable to a conventional coin pay-out apparatus in which the rotary disc 24 is disposed at an inclined. It is applicable not only to a coin pay-out apparatus for a slot machine but also to a coin pay-out apparatus used in a money exchanger and various other apparatuses as long as they use a rotary disc to be driven by a motor with similar results.

As will be apparent from the foregoing description, according to the present invention, the motor for actuating the coin pay-out apparatus is driven only when a combination of a plurality of binary signals is found to be a predetermined one. Furthermore, the combination of such signals includes the respective binary signals. Accordingly, even if a plurality of input signals are transferred into one signal level all at once due to noise caused by static electricity, etc. or the program for controlling the coin pay-out apparatus misfunctions, the coin pay-out apparatus is not actuated. Thus, the present invention is very effective when used as an apparatus for preventing erroneous operation.

Furthermore, according to the present invention, when no coins are paid even if a coin pay-out apparatus is actuated, the rotary disc rotating in the normal direction for coin pay-out is automatically rotated in the reverse direction for a certain time. By rotating the rotary disc in the reverse direction in this way, the coin is subjected to the reverse rotation force of the rotary disc, thereby to automatically clear the coin jam. Thus, the difficulty of eliminating coin jams as often experienced when the conventional apparatus is used can be avoided. In this way, the present invention proves itself to be very effective.

While particular embodiments of the present invention have been shown in the drawings and described above, it will be apparent that many changes may be made in the form, arrangement and positioning of the various elements of the combination. Therefore, it should be understood that preferred embodiments of the present invention disclosed herein are intended to be illustrative only and not intended to limit the scope of the present invention.

What is claimed is:

1. A coin pay-out apparatus in which a rotary disc is rotated by a motor having a drive circuit having a plurality of separate input terminals to effect a coin pay-out comprising:

means for controlling said motor by a plurality of different binary input signals fed simultaneously to said separate input terminals of said drive circuit; and means for paying coins only when a combination of said plurality of different input signals is found to be a predetermined combination.

2. A coin pay-out apparatus according to claim 1, wherein said controlling means comprises:

a prize judging circuit for outputting a coin pay-out signal and a signal corresponding to the value of a prize;

a normal rotation signal generating circuit for receiving said coin pay-out signal from said prize judging circuit and outputting an "H" signal;

a motor driving circuit receiving said "H" signal by a first input terminal thereof;

a coin number setting circuit for receiving said corresponding signal and setting a coin number corresponding to the value of a prize; and a comparator for comparing the coin number set in said coin number setting circuit with the coin number actually discharged from said rotary disc and outputting at least one of a non-conformity signal and a conformity signal, said non-conformity signal being inputted into a second input terminal of said motor driving circuit and said conformity signal being inputted into a third input terminal thereof.

3. A coin pay-out apparatus according to claim 1, wherein said predetermined input signals include a normal rotation signal for rotating said motor in the direction for paying coins, a reverse rotation signal for rotating said motor in the reverse direction, and a driving signal generated until the time the number of paid-out coins reaches a predetermined number.

* * * * *